US008205679B2

(12) United States Patent
Alff et al.

(10) Patent No.: US 8,205,679 B2
(45) Date of Patent: Jun. 26, 2012

(54) METHOD FOR EFFICIENT DEPLOYMENT OF INTELLIGENT COMPLETIONS

(75) Inventors: Michael Alff, Sugar Land, TX (US); Angel Reyes, Sugar Land, TX (US); Emmanuel Rioufol, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 394 days.

(21) Appl. No.: 12/486,324

(22) Filed: Jun. 17, 2009

(65) Prior Publication Data

US 2010/0319936 A1 Dec. 23, 2010

(51) Int. Cl.
*E21B 19/00* (2006.01)

(52) U.S. Cl. ..... 166/378; 166/387

(58) Field of Classification Search ..... 166/250.17, 166/378, 387, 385
See application file for complete search history.

(56) References Cited

U.S. PATENT DOCUMENTS 5,831,156 A 11/1998 Mullins
6,581,682 B1 6/2003 Parent et al.
6,752,397 B2 6/2004 Kohli et al.
6,886,391 B2 5/2005 Kohli et al.
6,919,512 B2 7/2005 Guven et al.
7,216,719 B2 5/2007 Ahmed et al.
7,220,067 B2 5/2007 Rubinstein et al.
7,340,819 B2 3/2008 Guven et al.
7,503,395 B2 3/2009 Meijer et al.
2004/0067002 A1 4/2004 Berg et al.
2004/0194955 A1 10/2004 Kohli et al.
2005/0213898 A1 9/2005 Rubinstein et al.
2005/0279442 A1 12/2005 Guven et al.
2006/0196660 A1 9/2006 Patel
2006/0243454 A1 11/2006 Bolze et al.
2006/0260817 A1 11/2006 Meijer et al.
2007/0062710 A1 3/2007 Pelletier et al.
2007/0237467 A1 10/2007 Rubinstein et al.
2009/0056947 A1 3/2009 Du et al.

OTHER PUBLICATIONS

International Search Report and Written Opinion dated Aug. 5, 2010.

*Primary Examiner* — Daniel P Stephenson
(74) *Attorney, Agent, or Firm* — Brandon S. Clark

(57) ABSTRACT

A technique enables efficient deployment of instrumentation gauges in a wellbore. The technique comprises preparing offline a plurality of assemblies having a combined packer and gauge mandrel with an associated gauge. Each assembly is combined with a segment or length of instrumentation cable that is fully spliced with the gauge during offline assembly time. Various splice halves also can be assembled during offline assembly time.

8 Claims, 5 Drawing Sheets

METHOD FOR EFFICIENT DEPLOYMENT OF INTELLIGENT COMPLETIONS

BACKGROUND

The following descriptions and examples are not admitted to be prior art by virtue of their inclusion in this section.

In a variety of well related applications, an intelligent completion may be deployed downhole into a wellbore via a tubing or other conveyance. A surface rig may be employed to deliver the intelligent completion to a desired location in the wellbore. The intelligent completion comprises gauges that can be used to detect and measure a variety of well related parameters. In multizone wells, one or more gauges are positioned in each well zone to monitor parameters related to that specific zone. The gauges are connected by an instrumentation cable which extends to a control system located at the surface.

Segments of the instrumentation cable are connected or spliced between the various gauges in the intelligent completion. Conventionally, the splices are formed during online rig assembly time, however rig time is a valuable commodity and operation of the rig can result in substantial costs. Online rig assembly time, referred to as "online" is the operating time in which the critical path for a rig is governed by the tool assembly at substantial cost. In contrast, offline assembly time, referred to as "offline" is any equipment assembly time in which the critical path for the rig is not governed by the tool assembly. The offline time is much less expensive than the online time. Formation of the instrumentation cable splices substantially increases the online rig assembly time which, in turn, substantially increases the expense and the difficulty of deploying intelligent completions in the wellbore.

SUMMARY

In general, the present invention provides a technique for efficiently deploying instrumentation gauges in a wellbore. The technique comprises preparing offline a plurality of assemblies having a combined packer and gauge mandrel with an associated gauge. Each assembly is combined with a segment or length of instrumentation cable that is fully spliced with the gauge during offline assembly time. Various splice halves also can be assembled during offline assembly time to facilitate a substantially more efficient deployment of the overall intelligent completion.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
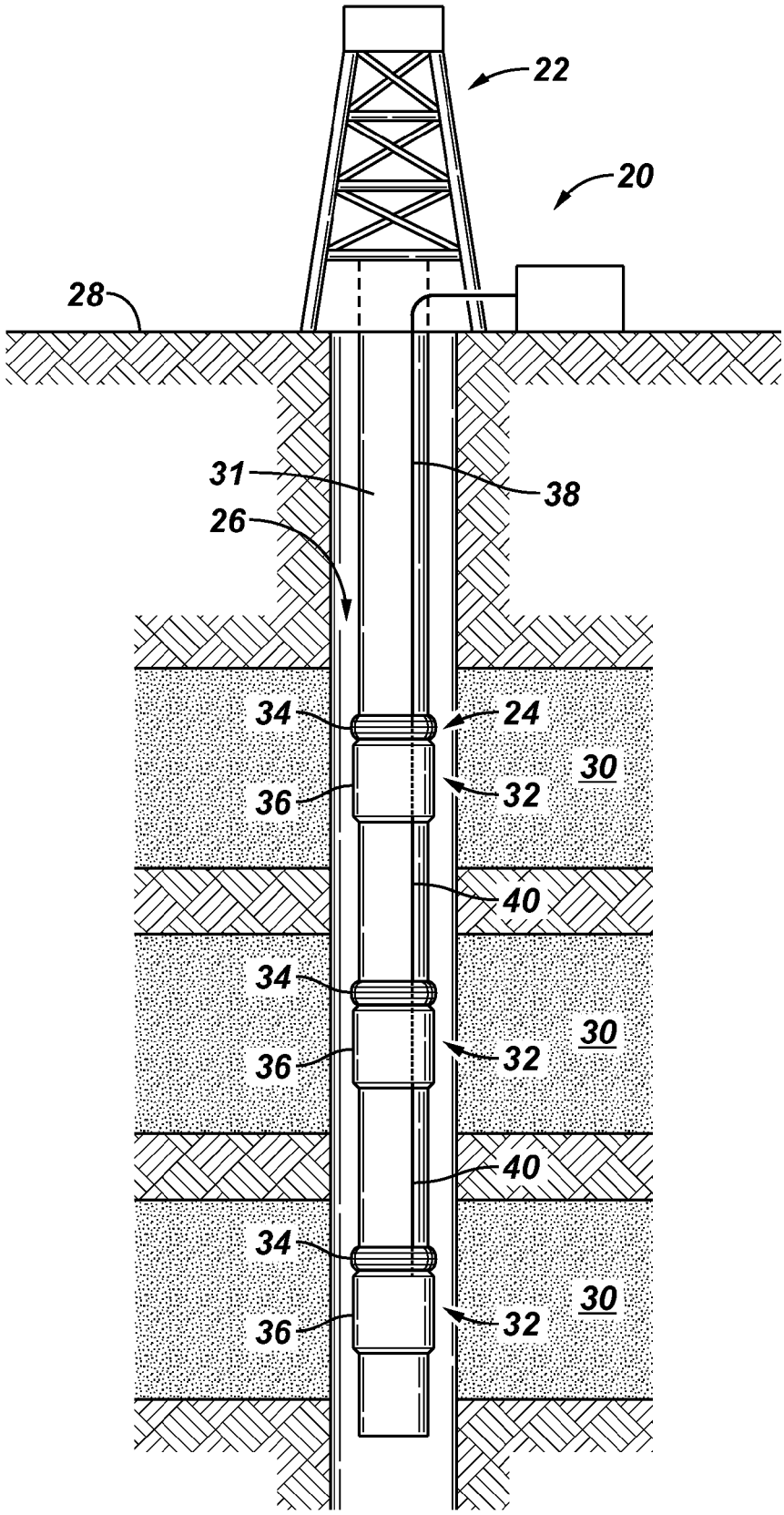
FIG. 1 is a schematic illustration of one example of an intelligent completion conveyed downhole via a rig, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally involves a system and methodology to facilitate the deployment of intelligent completions that can be used in subterranean environments. In well related applications, an intelligent completion is deployed downhole into a wellbore in a significantly more efficient manner than conventional systems. Depending on the specific application, substantial segments of the intelligent completion are pre-constructed during offline assembly time which greatly reduces the online rig assembly time that would otherwise be required. This premaking of portions of the intelligent completion noticeably increases the efficiency of rig usage.

Several deployment methods are described below as examples of more efficient approaches to deployment of gauges and the overall intelligent completion. In each example, the completion comprises a multizone completion separated by packers. Each well zone is instrumented by at least one instrumentation gauge, and those gauges are powered via an instrumentation cable. The instrumentation cable also can be used to convey data between the gauges and a control/monitoring system. Generally, the instrumentation cable is run along the length of the intelligent completion and uses splices to attach the instrumentation cable to the gauges and to connect the cable above and/or below each packer.

To minimize the online deployment time of the intelligent completion, the deployment methodology enables significant offline preparation. For example, each packer and corresponding gauge mandrel can be preassembled offline to create a combined assembly that may be shipped to the rig floor. Additionally, a segment of instrumentation cable may be deployed through the packer and spliced with a gauge on the combined gauge mandrel to enable creation of full/complete splices during offline assembly time. The segment of instrumentation cable extends from the top of the packer for attachment to the next sequential assembly that will be located in the well zone above.

The gauges, gauge mandrels, packers and instrumentation cable are run downhole into a wellbore by sequentially attaching the components (in the form of combined assemblies) to well tubing from the bottom up, and the well tubing is lowered into the wellbore. The present methodology provides the flexibility to prepare the assemblies and a plurality of full splices and splice halves during offline assembly time. Furthermore, the packer for each well zone can be combined with a gauge mandrel and its associated gauge into a single assembly. By way of example, each assembly may comprise a packer directly coupled with the gauge mandrel.

Referring generally to FIG. 1, an example of a well related application is illustrated. In this example, a well system 20 comprises a rig 22 used to deliver an instrumented completion 24 downhole into a wellbore 26. Rig 22 is positioned at a surface location 28, such as a land surface location, from which wellbore 26 is drilled down through a plurality of well zones 30. Depending on the specific application, instrumented completion 24 may comprise many types of components and assemblies used in a variety of well related operations. As illustrated, instrumented completion 24 comprises a plurality of assemblies 32 delivered downhole via a well string 31, e.g. a tubing string, to a desired location in wellbore 26. Each assembly 32 may comprise a packer 34 combined with a gauge mandrel 36 having one or more gauges.

The instrumented completion 24 also comprises an instrumentation cable 38 that can ultimately be used to provide power to the assemblies 32 and/or to provide data signals to or from the assemblies 32. The instrumentation cable 38 is formed with a plurality of cable segments, e.g. cable segments 40, which are spliced between the sequential assemblies 32 spaced for positioning in corresponding well zones 30. For example, the cable segments 40 may be spliced between sequential gauges of the assemblies 32. As discussed above, one or more full splices as well as one or more splice halves can be premade during offline assembly time to enable a much more efficient use of online rig time.

Figure 2:
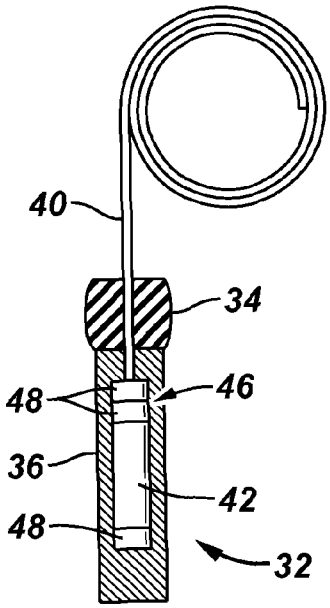
FIG. 2 is a schematic view of one example of an assembly having a combined packer and gauge mandrel, according to an embodiment of the present invention.

Referring generally to FIG. 2, one embodiment of a combined assembly 32 is illustrated. In this example, the packer 34 is preassembled with the gauge mandrel 36 during offline assembly time. Additionally, at least one gauge 42 is mounted to gauge mandrel 36, and a suitable instrumentation cable segment 40 is routed through packer 34 for connection with gauge 42. By way of example, a first end 44 of segment 40 is spliced with gauge 42 via a full splice 46 that is fully formed during offline assembly time. The full splice 46 may be formed by joining two splice halves 48. An additional splice half 48 may be preassembled offline at a bottom of the gauge 42.

The components of assembly 32 may be combined in a variety of ways depending on the overall configuration of instrumented completion 24. For example, the packer 34 and gauge mandrel 36 can be assembled directly together (without tubing in between) using a coupling or connection which allows their eccentricity to face the same direction. The connection between packer 34 and gauge mandrel 36 can be formed via timed connections, barreting, premium connections, or other connection techniques. Additionally, instrumentation cable segment 40 may be fed through the packer 34 from above and connected to gauge 42 via full splice 46. The segment 40 can be made in a variety of lengths that depend on the deployment methodology employed.

Figure 3:
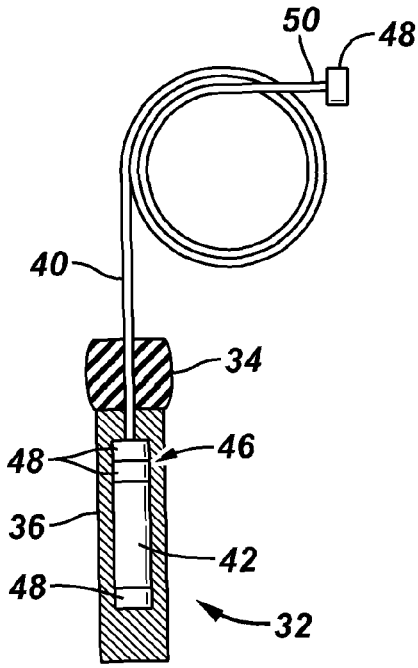
FIG. 3 is a schematic view of another example of an assembly having a combined packer and gauge mandrel, according to an embodiment of the present invention.

Referring generally to FIG. 3, an alternate embodiment of combined assembly 32 is illustrated. In this embodiment, the features are similar to those described above with reference to FIG. 2. However, an additional splice half 48 is attached to a second end 50 of instrumentation cable segment 40. The splice half 48 attached to the second end 50 also is preassembled during offline assembly time to reduce the otherwise required online rig assembly time.

A deployment methodology for implementing this type of combined assembly 32 into instrumented completion 24 is described with reference to FIG. 4. In this example, the cable segment 40 is precut to extend above the packer 34 a distance "X" which is equal to the distance between the packer 34 and the splice half 48 disposed at the bottom of the gauge 42 of the next sequential assembly 32 located in the above well zone 30. The cable segment 40 may be cut to have a small amount of extra length to accommodate the connection. Initially, the assembly 32 is attached to the tubing string 31 and then the instrumentation cable segment 40 is run from the packer 34 to the gauge 42 in the zone above. The instrumentation cable segment 40 is then connected to the gauge above via a suitable splice. With this methodology, only two splices are required per completion well zone with one splice located above each gauge 42 and one splice located below each gauge 42.

Figure 4:
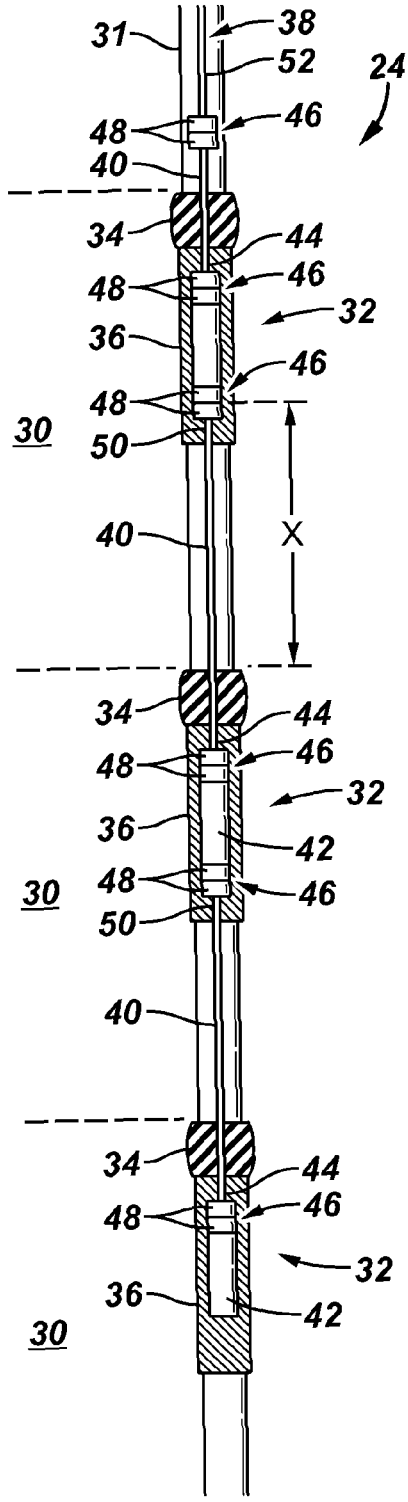
FIG. 4 is a schematic view of a plurality of assemblies combined into an intelligent completion via one example of a deployment methodology, according to an embodiment of the present invention.

In the example illustrated in FIG. 4, the full splice 46 at the bottom of each gauge 42 is made by connecting two premade splice halves 48, both of which may be assembled offline. The splice halves 48 at the bottom of each gauge 42 are then connected to each other online. This process is repeated for each sequential assembly 32 that corresponds to each well zone 30. In the illustrated embodiment, three assemblies 32 corresponding to three separate well zones are illustrated, but the number of assemblies and well zones may be different for other applications. The splice half 48 of the cable segment 40 above the uppermost packer 34 is connected to a corresponding splice half 48 mounted to the instrumentation cable of a main cable spool 52. The splice half 48 on the main cable spool 52 also can be prepared in advance during offline assembly time; however the actual connection of main cable spool 52 to the upper cable segment 40 is accomplished online. It should be noted that the lowermost assembly 32 does not require a splice half 48 at the bottom of its gauge 42.

In some instances, the length "X" of the cable extending above the packer 34 may be adjusted to the actual tubing length. In this case, the position of the top splice half 48 may be adjusted using a slack management sub designed to store excess length of instrumentation cable. Alternatively, the length of the tubing can be adjusted by adding or removing tubing pup joints. Other techniques also may be used, when necessary, to adjust the "X" length.

The embodiment described with reference to FIGS. 3 and 4 substantially reduces online rig assembly time by enabling the premaking of various splice components during offline assembly time. With a three zone completion, for example, three full splices 46 and several additional splice halves 48 can be prepared during offline assembly time.

Figure 5:
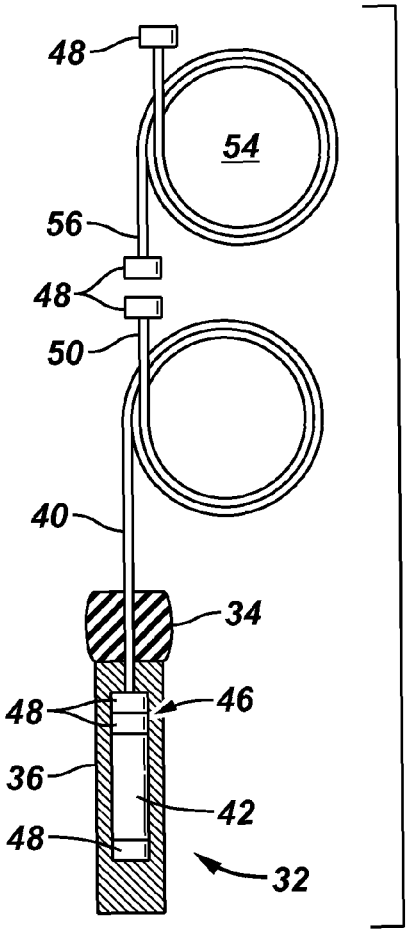
FIG. 5 is a schematic view of another example of an assembly having a combined packer and gauge mandrel, according to an embodiment of the present invention.

In another embodiment, a precut instrumentation cable coil 54 is constructed, as illustrated in FIG. 5. The cable coil 54 comprises an instrumentation cable coil segment 56 having a splice half 48 attached at each of its ends. The cable coil 54 with its splice halves 48 can be premade during offline assembly time. Accordingly, this method uses a shorter, fixed length of cable segment 40 to enable formation of a splice near the top of each packer 54. The precut cable coil 54 is spliced to cable segment 40 online, as illustrated by the splices 46 directly above each packer 34 in FIG. 6. The precut cable coil 54 is then run up to the bottom of the next sequential gauge 42 over a distance "Y" for online connection to the bottom of the next sequential gauge 42 via, for example, a suitable splice. According to this deployment method, three splices 46 are used per completion zone.

Figure 6:
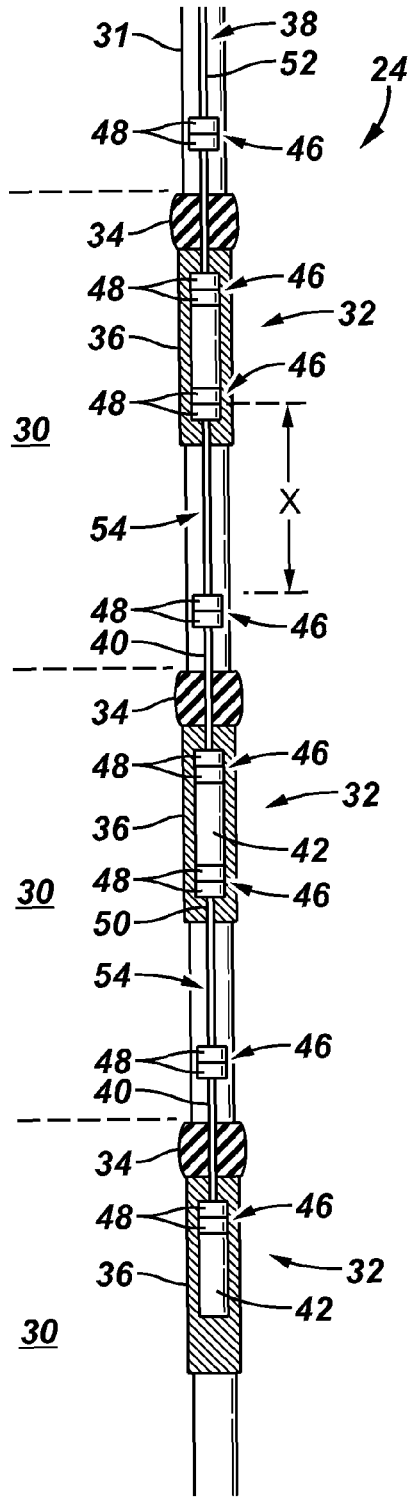
FIG. 6 is a schematic view of a plurality of assemblies combined into an intelligent completion via another example of a deployment methodology, according to an embodiment of the present invention.

In the deployment method illustrated in FIGS. 5 and 6, each assembly is formed in a manner similar to that described above with reference to the embodiment illustrated in FIGS. 3 and 4. However, the instrumentation cable coil 54 is used to place one splice 46 above each packer 34. Initially, the lower assembly 32 is run downhole, and the separate cable coil 54 is connected to the cable segment 40 above the lowermost packer 34 via two premade splice halves 48. The upper premade splice half 48 of cable coil 54 is then extended to the bottom of the next sequential gauge 42, located above, and connected to the bottom of that gauge via two premade splice halves 48. This process can be repeated for each remaining completion zone.

The length "Y" of each cable coil 54 is measured to correctly match the tubing length (also called a space out) and thereby properly position its upper splice half 48 below the next sequential gauge 42. The splice half 48 of the cable segment 40 above the uppermost packer 34 is connected to a corresponding splice half 48 mounted to the instrumentation cable of main cable spool 52. The splice half 48 on the main cable spool 52 also can be prepared in advance during offline assembly time; however the actual connection of main cable spool 52 to the upper cable segment 40 is accomplished online. It should again be noted that the lowermost assembly 32 does not require a splice half 48 at the bottom of its gauge 42.

The embodiment described with reference to FIGS. 5 and 6 substantially reduces online rig assembly time by enabling the premaking of various splice components during offline assembly time. With a three zone completion, for example, three full splices 46 and additional splice halves 48 can be prepared offline. In this embodiment, sets of additional splice halves 48 for combination into full splices 46 can be prepared during offline assembly time.

Figure 7:
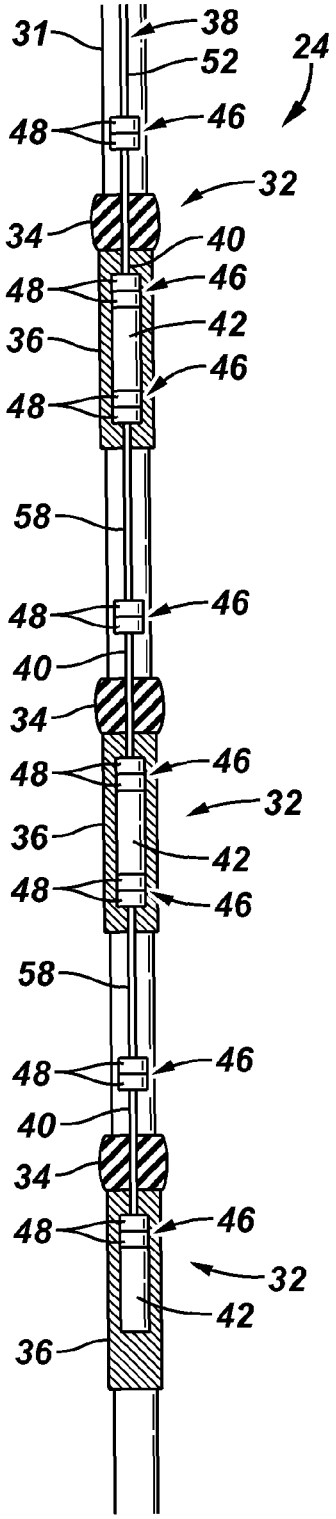
FIG. 7 is a schematic view of a plurality of assemblies combined into an intelligent completion via another example of a deployment methodology, according to an embodiment of the present invention.

Referring generally to FIG. 7, another deployment method is described as able to facilitate the efficient deployment of gauges 42 downhole in instrumented completion 24. In this embodiment, deployment of the instrumented completion 24 occurs in a similar manner to that described with reference to FIGS. 5 and 6. However, an instrumentation cable segment 58 is spliced to cable segment 40 above each packer 34. The cable segment 58 is initially part of a cable spool which is extended/unspooled until cable segment 58 extends to a location proximate the bottom of the next sequential gauge 42 located above. The cable segment 58 is then cut and spliced to the bottom of the next sequential gauge 42. By way of example, a splice half 48 can be attached to the upper end of cable segment 58 to enable formation of full splice 46 at the bottom of the next sequential gauge 42. According to this deployment method, three full splices are used in each completion zone.

The methodology used to construct and deploy the instrumented completion 24 of FIG. 7 is very similar to the previous embodiment but it does not employ the separate coil of length "Y" as described above. After cutting each cable segment 58 and displacing the cable segment to the next sequential gauge 42, the process is repeated for each of the completion zones to be deployed in a corresponding well zone 30. In this embodiment, the full splice 46 at the lower end of each gauge 42 is assembled with one splice half 48 premade offline and one splice half 48 prepared online. Again, the splice half 48 of the cable segment 40 above the uppermost packer 34 is connected to a corresponding splice half 48 mounted to the instrumentation cable of main cable spool 52. The splice half 48 on the main cable spool 52 may be prepared in advance during offline assembly time; however the actual connection of main cable spool 52 to the upper cable segment 40 is accomplished online. It should be noted that a plurality of cable spools can be used to enable pre-making of a plurality of splice halves 48 during the offline assembly time.

The embodiment described with reference to FIG. 7 substantially reduces online rig assembly time by enabling the premaking of various splice components during offline assembly time. With a three zone completion, for example, three full splices 46 and five additional, individual splice halves 48 can be prepared offline.

Figure 8:
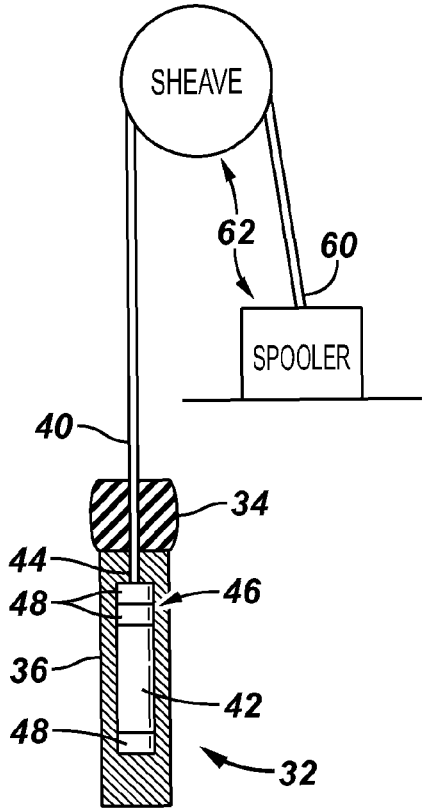
FIG. 8 is a schematic view of another example of an assembly having a combined packer and gauge mandrel, according to an embodiment of the present invention.
Figure 9:
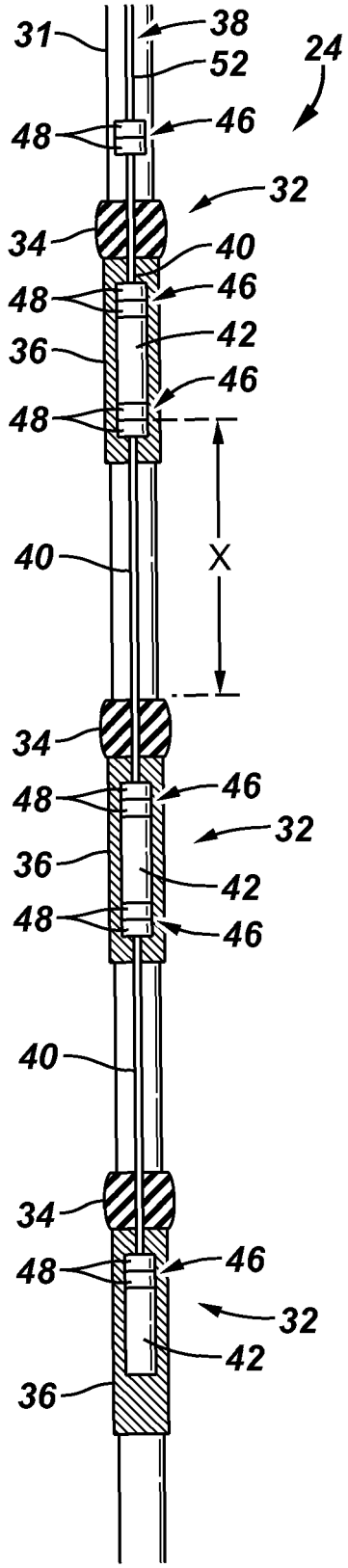
FIG. 9 is a schematic view of a plurality of assemblies combined into an intelligent completion via another example of a deployment methodology, according to an embodiment of the present invention.

Another embodiment of a deployment methodology is described with reference to FIGS. 8 and 9. In this embodiment, the instrumentation cable segment 40, extending from gauge 42 up through packer 34, has a precut length with an open end 60 that does not include a preassembled splice half. The precut length is sufficient to extend through a distance "X", as illustrated in FIG. 9, with an appropriate excess length. The excess length enables the instrumentation cable segment 40 to be run downhole in a portable spooler and sheave system 62, as illustrated schematically with dashed lines in FIG. 8. By way of example, system 62 may comprise a portable spooler located on a rig floor with a sheave located above the portable spooler. The portable spooler and sheave system 62 may be attached to the instrumentation cable segment and used after each assembly 32 is "made up" and attached to the completion 24.

When the instrumented completion 24 is deployed according to this latter method, each assembly 32 is run downhole with its open ended cable segment 40 placed on portable spooler and sheave 62. The device allows the cable segment 40 to be selectively extended to the bottom of the next sequential gauge 42 located above. When the gauge 42 is reached, the instrumentation cable segment 40 is cut to an appropriate length via portable spooler and sheave 62. The upper end of instrumentation cable segment 40 is then connected to the bottom of the next sequential gauge 42. By way of example, the cut end may be combined with a splice half 48 while online for online splicing with a corresponding splice half 48 mounted at the bottom of gauge 42.

This process is repeated for each sequential assembly 32 that corresponds to each well zone 30. The splice half 48 of the cable segment 40 above the uppermost packer 34 may be premade during offline assembly time with a suitable splice half 48. The splice half 48 prepared during offline assembly time is then spliced online to a corresponding splice half 48 mounted to the instrumentation cable of a main cable spool 52. The splice half 48 on the main cable spool 52 also can be prepared in advance during offline assembly time. With this methodology, only two splices are required per completion well zone with one splice located above each gauge 42 and one splice located below each gauge 42.

The embodiment described with reference to FIGS. 8 and 9 substantially reduces online rig assembly time by enabling the premaking of various splice components during offline assembly time. With a three zone completion, for example, three full splices 46 can be prepared offline. Also, three additional splice halves 48 can be prepared during offline assembly time.

Examples of techniques for deploying gauges and instrumented completions have been provided. However, the assemblies and methodologies for forming the completions may vary depending on the well applications and well environments. In some applications, the number of well zones and corresponding completion zones will be different and the instrumented completion can be designed accordingly. Although the various techniques are useful in increasing the efficiency of completion deployment by reducing online rig assembly time, the techniques also can be used in other applications.

Additionally, one or more instrumentation cables may be utilized in a given instrumented completion. The number and type of communication lines in each instrumentation cable also may vary. The components used in each combined assembly may be altered or adjusted according to the needs of a given application. Similarly, the components used to form the various splices can be constructed in a number of sizes and configurations, and those components can vary according to specific applications. The distances between combined assemblies can be selected according to the number and spacing of the subterranean well zones.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of deploying instrumentation gauges in a wellbore, comprising:

providing a plurality of gauge mandrels with gauges;

preassembling each gauge mandrel of the plurality of gauge mandrels with a corresponding packer during offline assembly time;

determining the number of preassembled gauge mandrel and packer assemblies to be installed downhole in the wellbore;

determining a distance between the top of a packer and the bottom of the gauge mandrel which will be disposed sequentially uphole of the packer;

cutting a length of instrumentation cable to a length of about the determined distance;

splicing a first end of the length of instrumentation cable to a gauge to form a complete splice during offline assembly time;

preparing a second end of the length of instrumentation cable for connection to a next sequential gauge; and conveying the gauge mandrels and the corresponding packers downhole into the wellbore.

2. The method as recited in claim 1, further comprising attaching each gauge mandrel to a tubing string.

3. The method as recited in claim 2, further comprising preparing a splice half on the second end of the length of instrumentation cable during offline assembly time.

4. The method as recited in claim 3, further comprising assembling a lower gauge splice half below each gauge during offline assembly time; and connecting each lower gauge splice half with the splice half on the second end of the length of instrumentation cable extending from an adjacent completion zone.

5. A method of deploying instrumentation gauges in a wellbore, comprising:

providing a plurality of gauge mandrels with gauges;

preassembling each gauge mandrel of the plurality of gauge mandrels with a corresponding packer during offline assembly time;

determining the number of preassembled gauge mandrel and packer assemblies to be installed downhole in the wellbore;

determining a first distance between the top of a packer and the bottom of the gauge mandrel which will be disposed sequentially uphole of the packer;

cutting a first length of instrumentation cable, during offline assembly time, to a first length that is less than the determined distance;

splicing a first end of the first length of instrumentation cable to the top of a gauge to form a complete splice during offline assembly time;

cutting a second length of instrumentation cable, during offline assembly time, to a second length, wherein the first and second lengths combined are about the same as the determined distance; and conveying the gauge mandrels and the corresponding packers downhole into the wellbore.

6. The method as recited in claim 5, further comprising attaching each gauge mandrel to a tubing string.

7. The method as recited in claim 5, further comprising assembling splice halves, during offline assembly time, on the second end of the first length of instrumentation cable, and on the first and second ends of the second length of instrumentation cable.

8. The method as recited in claim 7, further comprising:

assembling a lower gauge splice half below each gauge during offline assembly time;

connecting the lower gauge splice half with the first end of the second length of instrumentation cable to form a complete splice; and connecting the second end of the second length of instrumentation cable with the second end of the first length of instrumentation cable to form a complete splice.

* * * * *